United States Patent [19]

Fischer

[11] 4,133,431

[45] Jan. 9, 1979

[54] PACKAGING OF TABLETS

[75] Inventor: Charles F. Fischer, Jersey City, N.J.

[73] Assignee: Colgate-Palmolive Company, New York, N.Y.

[21] Appl. No.: 875,795

[22] Filed: Feb. 7, 1978

Related U.S. Application Data

[63] Continuation of Ser. No. 746,817, Dec. 2, 1976, abandoned.

[51] Int. Cl.[2] ..... B65D 65/26; B65D 83/04

[52] U.S. Cl. ..... 206/532; 206/497; 206/534; 206/538; 206/603

[58] Field of Search ..... 206/8, 83-84, 206/303, 445, 497, 526, 528, 532, 534-535, 538-539, 601, 603; 229/40, 42, 87 R, DIG. 12

[56] References Cited

U.S. PATENT DOCUMENTS

| | | | |
|---|---|---|---|
| 1,813,178 | 7/1931 | Lindsley | 206/303 |
| 2,138,241 | 11/1938 | Koch et al. | 206/354 X |
| 2,386,416 | 10/1945 | Wilhelm | 206/539 |
| 2,912,102 | 11/1959 | Scott | 206/394 X |
| 3,236,369 | 2/1966 | Moore | 206/535 X |
| 3,412,524 | 11/1968 | Nestell et al. | 229/DIG. 12 X |
| 3,689,458 | 9/1972 | Hellstrom | 206/532 X |

*Primary Examiner*—Steven E. Lipman

*Attorney, Agent, or Firm*—Strauch, Nolan, Neale, Nies & Kurz

[57] ABSTRACT

A stack of brittle tablets are shrink wrapped with thin rigid separator and indicator elements between each tablet group (one or several) and at the ends of the stack.

7 Claims, 9 Drawing Figures

FIG. 1
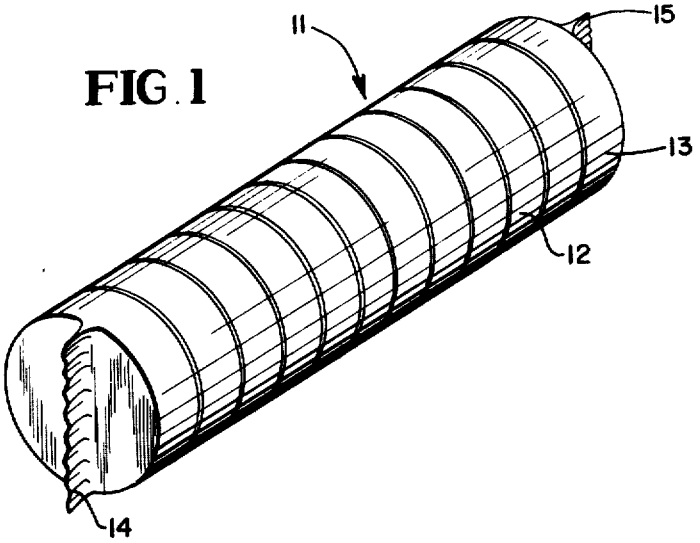
FIG. 2
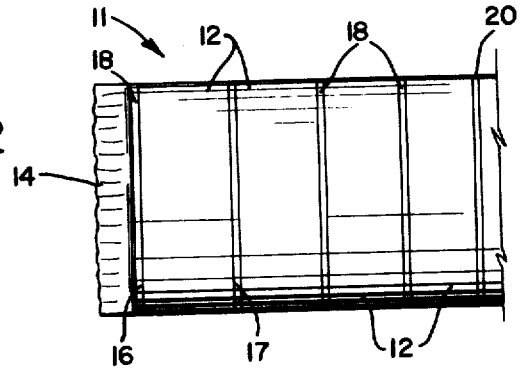
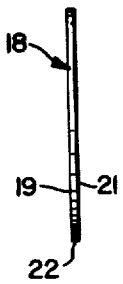
FIG. 3
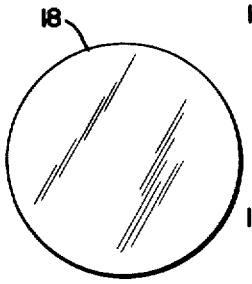
FIG. 4
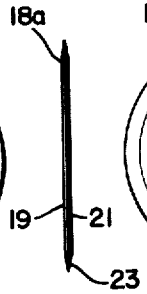
FIG. 5
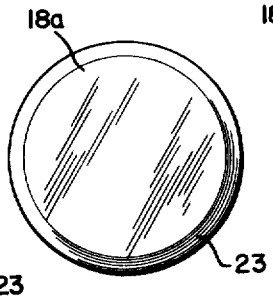
FIG. 6
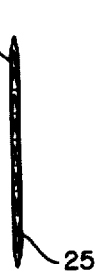
FIG. 7
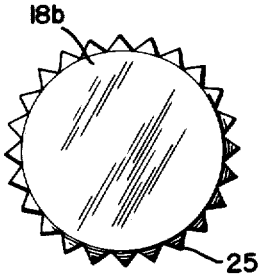
FIG. 8
FIG. 9
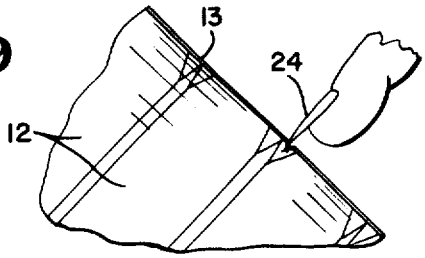

PACKAGING OF TABLETS

This invention relates to the packaging of relative brittle tablets and is particularly concerned with such packaging wherein the tablets are protected against lateral fracture and localized disintegration arising from forces encountered during shrink packaging and in handling and storage by separation elements provided between tablet groups of one or more and at the opposite ends of the package.

In its preferred embodiment the invention will be disclosed as applied to the packaging of detergent tablets. These tablets are composed of compressed relatively soft granular material and are relatively brittle and subject to fracture and/or localized disintegration especially near the periphery when stacked for packaging and subjected to the lateral forces incident to packaging, and also when handled and stored after packaging.

It is an important feature of the invention that such fracture and disintegration is minimized and usually avoided by providing separator elements between groups of tablets in the shrink wrapped stack (a group may consist of one or several stacked tablets) which elements besides affording such protection also provide marking means indicating separation of the groups.

Pursuant to the foregoing the separator elements are preferably smooth and thin but relatively rigid plastic discs whose peripheral diameter may be about equal to or slightly more than that of the tablets, and whose peripheries may be beveled, toothed or otherwise irregular in form to facilitate severing the wrap for selective removal of tablets.

Further features will appear as the description proceeds in connection with the appended claims and the annexed drawings.

BRIEF DESCRIPTION OF DRAWINGS

FIG. 1 is a generally perspective view showing packaged tablets according to a preferred embodiment of the invention;

FIG. 2 is an enlarged fragmentary view illustrating separator elements at the package end and between adjacent tablets;

FIG. 3 and FIG. 4 are end and side views respectively showing one form of separator element;

FIG. 5 and FIG. 6 are end and side views respectively showing another form of separator element;

FIG. 7 and FIG. 8 are end and side views respectively showing a further form of separator element; and FIG. 9 is an enlarged fragmentary view diagrammatically showing one mode of opening the package.

PREFERRED EMBODIMENTS

FIG. 1 shows a package 11 comprising a plurality of tablets 12 of the same size enclosed in a transparent sleeve 13 that consists of any suitable shrink wrap material, such as a polyvinyl chloride film, with heat sealed end closures 14 and 15.

As shown in FIG. 2 each tablet 12 is of generally cylindrical form with flat parallel opposite sides 16 and 17. In this package each tablet is spaced from and prevented from contact with the adjacent tablet by a separator element 18. FIG. 2 also shows one of these separator elements 18 at one end of the package, and there is another separator element (not shown) at the other end of the package.

Each separator element 18 is preferably a smooth thin flat sided disc of sufficient thickness to maintain its shape under the normal lateral pressures encountered during packaging and handling. Referring to FIGS. 3 and 4, each disc 18 may be circular and quite thin as compared to tablet thickness. In some instances the separator elements may be of different color from the tablets to distinctly mark the package opening zones. The opposite sides 19 and 21 of the disc are flat and parallel, and the periphery 22 lies in a circle that advantageously has a diameter equal to or slightly greater than the tablet diameter. For example the separator discs may each have a diameter about 0.015" in excess of that of the tablets. However, as indicated at 20 at the right side of FIG. 2 the separator elements between the tablets may even be of slightly less diameter than the tablets to provide slightly recessed regions facilitating cutting the sleeve at those points.

FIGS. 5 and 6 show another form of separator **18*a* which is the same as FIGS. 3 and 4 except that the periphery is beveled as indicated at 23. As illustrated in FIG. 9 this provides for annular V-shaped spaces around the package between each tablet and separator element, and such facilitates opening the package at a particular region by enabling the ready insertion of a fingernail 24 or a knife edge to slit the sleeve. Also as shown in FIG. 9** the tablet edges may be slightly beveled to provide or better define these spaces.

Similarly, as shown in FIGS. 7 and 8, the periphery of each separator element **18*b* may be formed with serrations or a sawtooth contour indicated at 25**, for facilitating cutting of the sleeve at those points.

In some instances where the separator elements between the tablets are beveled, toothed or slightly undersized it may be preferred to provide slightly oversize circular elements 18 at the package ends for increased protection.

During packaging, the tablets are stacked within the sleeve with the separator elements between the respective groups and at opposite ends before shrinking, the ends are closed and the sleeve placed in an oven where it shrinks to substantially the form of FIG. 1.

During the packaging operation and subsequent handling of the package the separator elements prevent direct contact and rubbing together of adjacent tablets and thereby protect the relatively brittle tablets against partial or even complete disintegration.

While as above indicated it is preferred to provide a separator element between each adjacent tablet, the invention may be practiced by providing separator elements between groups of tablets, as for example between groups of two or three tablets, especially where more than one tablet is to be used for a single purpose.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a package wherein a stack of brittle tablets is contained in a shrink wrap enclosure, said tablets being of such fragile structure as to be susceptible to fracture or disintegration during normal packaging and transportation, the improvement wherein relatively thin stiff separator elements in substantially full surface engagement with adjacent tablets are disposed between groups of tablets in the stack and in contact with the tablets at the ends of the stack, each of said separator elements being a smooth sided disc of synthetic plastic materially thinner than a tablet, and each of said separator elements being peripherally formed with means for indicating package opening zones between successive groups of tablets and for facilitating severing of the package at those zones.

2. In the package defined in claim 1, wherein there is only one tablet in each group so that there is a separator element between each tablet.

3. In the package defined in claim 1, each of said separator elements having a peripheral diameter slightly larger than the adjacent tablets.

4. In the package defined in claim 1, the separator elements between tablet groups being of a different color than the tablets for marking group bounderies.

5. In the package defined in claim 1, each said separator element being peripherally formed to provide recessed regions facilitating opening the package around said regions.

6. In the package defined in claim 5, said separator elements having beveled peripheries.

7. In the package defined in claim 5, said separator elements having toothed peripheries.

* * * * *